US008307764B2

(12) United States Patent
Songer

(10) Patent No.: US 8,307,764 B2
(45) Date of Patent: Nov. 13, 2012

(54) PRINTING SLEEVE

(75) Inventor: Richard F. Songer, Little Valley, NY (US)

(73) Assignee: Luminite Products Corporation, Bradford, PA (US)

( * ) Notice: Subject to any disclaimer, the term of this patent is extended or adjusted under 35 U.S.C. 154(b) by 542 days.

(21) Appl. No.: 12/372,112

(22) Filed: Feb. 17, 2009

(65) Prior Publication Data

US 2010/0206193 A1 Aug. 19, 2010

(51) Int. Cl.
*B41F 13/10* (2006.01)
*B41F 5/00* (2006.01)
*B41F 13/20* (2006.01)

(52) U.S. Cl. ..... 101/375; 101/216; 101/376; 101/479

(58) Field of Classification Search ..... 101/375, 101/376, 479, 216
See application file for complete search history.

(56) References Cited

U.S. PATENT DOCUMENTS

| | | | | |
|---|---|---|---|---|
| 5,036,766 | A | 8/1991 | Songer | |
| 5,515,781 | A | 5/1996 | Songer | |
| 5,577,443 | A | 11/1996 | Songer | |
| 5,782,181 | A | 7/1998 | Rossini | |
| 5,819,657 | A | 10/1998 | Rossini | |
| 6,148,726 | A * | 11/2000 | Harada | 101/217 |
| 6,205,923 | B1 * | 3/2001 | Dawley et al. | 101/382.1 |
| 6,283,027 | B1 * | 9/2001 | Vrotacoe et al. | 101/376 |
| 2002/0023562 | A1 * | 2/2002 | Busshoff | 101/376 |
| 2002/0162467 | A1 * | 11/2002 | Palmatier et al. | 101/375 |
| 2005/0252399 | A1 * | 11/2005 | Petersen et al. | 101/375 |
| 2007/0256583 | A1 | 11/2007 | Ahler et al. | |
| 2009/0031910 | A1 | 2/2009 | Simon | |

FOREIGN PATENT DOCUMENTS

| | | | |
|---|---|---|---|
| JP | 2002-283540 | A | 10/2002 |
| WO | 01-89833 | A1 | 11/2001 |

OTHER PUBLICATIONS

Rossini S.p.a.: Carrier Sleeve website: http://www.rossini-na.com/eng/flexo_carrier_stat.php?menu=2&menu_flexo=7 (1 page).
rotec®—Airo Adapter website: http://www.dayintl.com/rotec/airo.htm (2 pages).
rotec®—Atlas Adapter website: http://www.dayintl.com/rotec/atlas.htm (2 pages).
rotec®—Bridge Adapter website: http://www.dayintl.com/rotec/bridge.htm (2 pages).
rotec®—Compressible Sleeve website: http://www.dayintl.com/rotec/compressible.htm (2 pages).
PCT—Notification of Transmittal of the International Search Report and the Written Opinion of the International Searching Authority, or the Declaration; dated Jul. 1, 2010 (2 pages).
PCT—International Search Report; dated Jul. 1, 2010 (3 pages).
PCT—Written Opinion of the International Searching Authority; dated Jul. 1, 2010 (3 pages).

* cited by examiner

*Primary Examiner* — Judy Nguyen
*Assistant Examiner* — Blake A Tankersley
(74) *Attorney, Agent, or Firm* — Brian B. Shaw, Esq.; Harter Secrest & Emery LLP

(57) ABSTRACT

A printing assembly includes a cylindrical sleeve having an inner surface and an outer surface. The inner surface defines a first channel and the outer surface defines a port fluidly connected to the first channel. The inner surface is configured for lateral movement along a nonporous surface in response to a first flow of pressurized air being directed into the first channel from the port. The inner surface is also configured to fixedly mate with the nonporous surface in response to removal of the flow.

16 Claims, 4 Drawing Sheets

PRINTING SLEEVE

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A "SEQUENCE LISTING"

Not applicable.

BACKGROUND OF THE INVENTION

1. Field of the Invention

The present disclosure relates to flexographic printing and, more specifically, to sleeves used with flexographic print presses.

2. Description of Related Art

Flexographic printing is commonly done on print presses in high speed automated environments. Such presses commonly include a variety of components configured to accept a moving web of material and to dispose a repeated image onto the web as it passes through the press. In such presses, the web is typically fed between a pair of cylinders acting in concert to dispose, for example, an ink-based or dye-based image on the web as it passes therebetween at a desired rate and pressure. For example, known print presses may include a cylindrical mandrel onto which a print sleeve may be disposed. The print sleeve may include a raised portion onto which ink may be disposed to form a corresponding image on the web as it passes adjacent to the raised portion. The raised portion may be formed integrally with the print sleeve or, alternatively, a printing plate may be adhered to and/or otherwise mounted to the print sleeve to form the image.

In known print presses, the print sleeve may be disposed at a desired location along the mandrel to facilitate an accurate and/or otherwise desirable location of the repeated image on the web. To facilitate mounting the cylindrical print sleeve on the mandrel and desirably positioning the print sleeve along the mandrel, a flow of pressurized air such as, for example, shop air may be directed through the mandrel to an inner surface of the print sleeve. To direct such a flow of pressurized air through the mandrel to the sleeve, prior art mandrels typically include a hollow portion fluidly connected to orifices formed by the outer surface of the mandrel to direct the flow out of the mandrel. Directing the flow in this way forms, for example, an air pocket between an inner surface of the print sleeve and the outer surface of the mandrel. At least a portion of known print sleeves may be circumferentially expandable and, thus, forming an inner pocket between the print sleeve and the mandrel may expand at least a portion of the print sleeve to allow the sleeve to slide more freely along the surface of the mandrel until the sleeve is disposed at the desired location. Once the print sleeve has been desirably positioned, the flow of air may be removed from the mandrel, thereby causing the print sleeve to contract and substantially lock in place on the mandrel.

However, prior art print sleeve/mandrel assemblies suffer from several deficiencies. For example, it is difficult and expensive to manufacture mandrels that are both robust enough to be used in a wide range of printing applications in manufacturing environments and that include a network of air passages appropriate for directing a flow of pressurized air from within the mandrel to an outer surface of the mandrel. In addition, because such orifices must be primarily disposed proximate a leading edge of the mandrel to facilitate disposing the print sleeve on the mandrel, prior art print sleeves must be substantially the same length as the mandrel so that a portion of the inner surface of the print sleeve is always covering the mandrel orifices while the print sleeve is disposed on the mandrel. It is understood that moving the print sleeve past the orifices of the mandrel will cause the print sleeve to lock in place on the mandrel and will leave the operator with no way of removing the print sleeve from the mandrel. However, manufacturing print sleeves that are substantially the same length as the air-fed mandrel on which they will be used can be extremely costly and may be unnecessary for applications in which the images being applied by the print sleeves are substantially narrower than the overall length of the mandrel.

The exemplary embodiments described herein solve the deficiencies of the prior art.

BRIEF SUMMARY OF THE INVENTION

In an exemplary embodiment of the present disclosure, a printing assembly includes a cylindrical sleeve having an inner surface and an outer surface, the inner surface defining a first channel and the outer surface defining a port fluidly connected to the first channel. The inner surface is configured for lateral movement along a nonporous surface in response to a first flow of pressurized air being directed into the first channel from the port. The inner surface is also configured to fixedly mate with the nonporous surface in response to removal of the flow.

In an additional exemplary embodiment of the present disclosure, method of mounting a sleeve includes engaging the sleeve with a mandrel such that a periphery of the mandrel is disposed within the sleeve, directing a first flow of pressurized air from a port defined by an outer surface of the sleeve to a first annular channel defined by an inner surface of the sleeve, and moving the sleeve laterally along the mandrel while directing the first flow to the first channel.

In still another exemplary embodiment of the present disclosure, a method mounting a sleeve includes disposing an inner surface of the sleeve about an outer surface of a mandrel, directing a flow of pressurized air from an outer surface of the sleeve to a first channel formed by the inner surface of the sleeve, and forming an air pocket defined by the outer surface of the mandrel and the inner surface of the sleeve to expand a portion of the sleeve. The method also includes moving the sleeve laterally along the outer surface of the mandrel, and removing the flow of pressurized air to contract the portion of the sleeve and fixedly mate the sleeve with the mandrel.

BRIEF DESCRIPTION OF THE SEVERAL VIEWS OF THE DRAWING(S)

Figure 2:
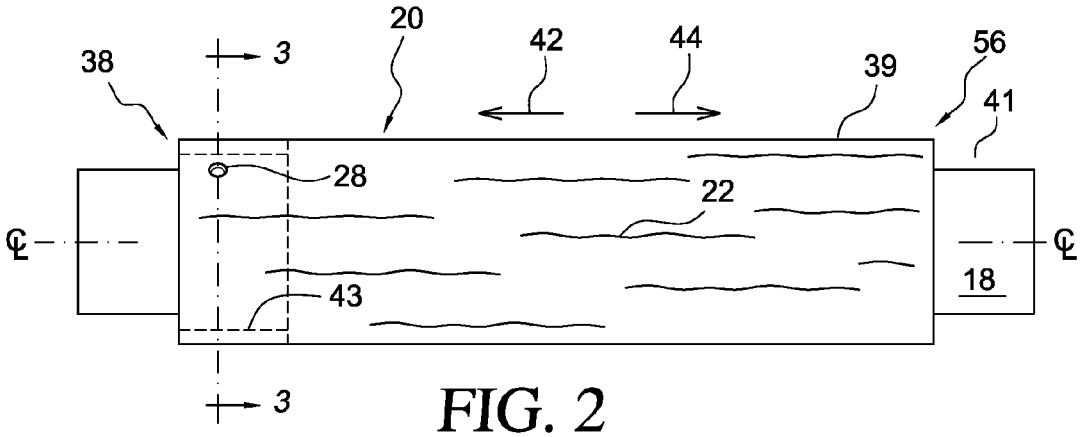
FIG. 2 illustrates a print sleeve disposed on a mandrel according to an exemplary embodiment of the present disclosure.
Figure 2A:
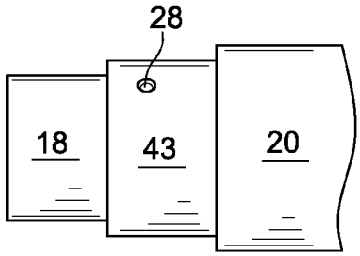

FIG. 2*a* illustrates a portion of a print sleeve and mandrel according to another exemplary embodiment of the present disclosure.

Figure 3:
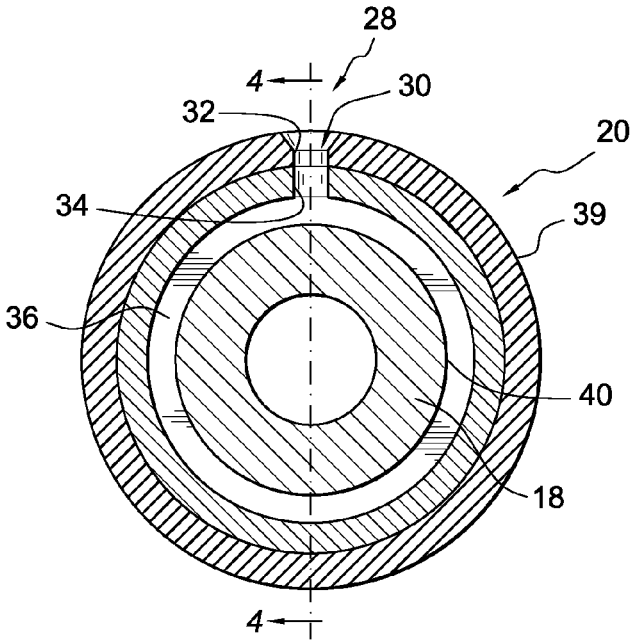

FIG. 3 is a cross-sectional view of the print sleeve and mandrel shown in FIG. 2.

Figure 4:
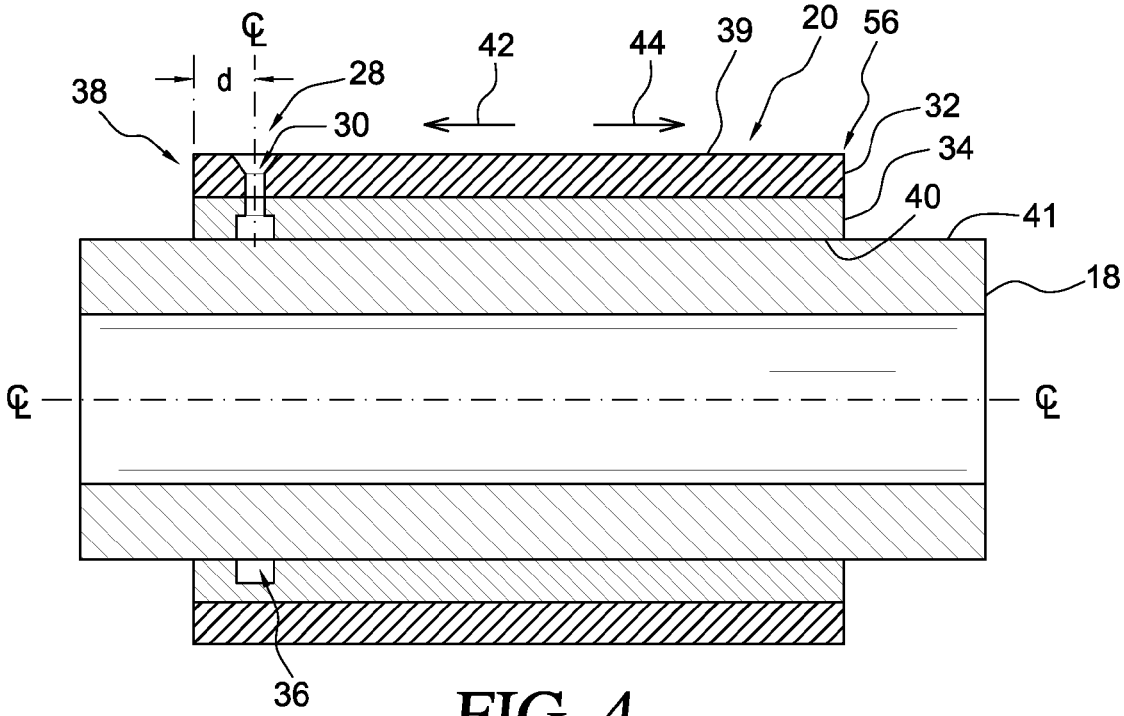

FIG. 4 is another cross-sectional view of the print sleeve and mandrel shown in FIG. 2.

Figure 5:
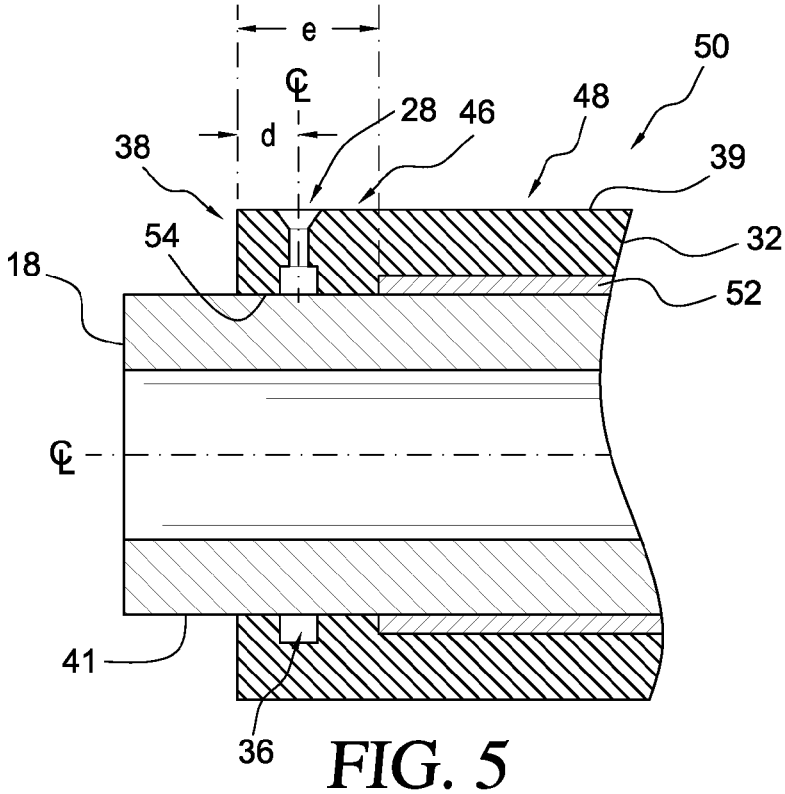

FIG. 5 is a partial cross-sectional view of a print sleeve and mandrel according to an additional exemplary embodiment of the present disclosure.

Figure 6:
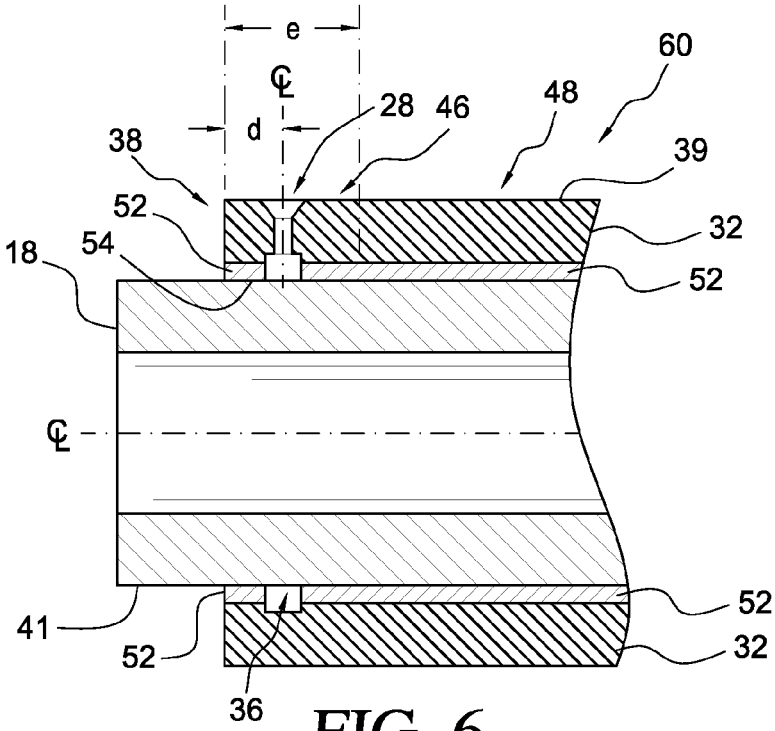

FIG. 6 is a partial cross-sectional view of a print sleeve and mandrel according to another exemplary embodiment of the present disclosure.

Figure 7:
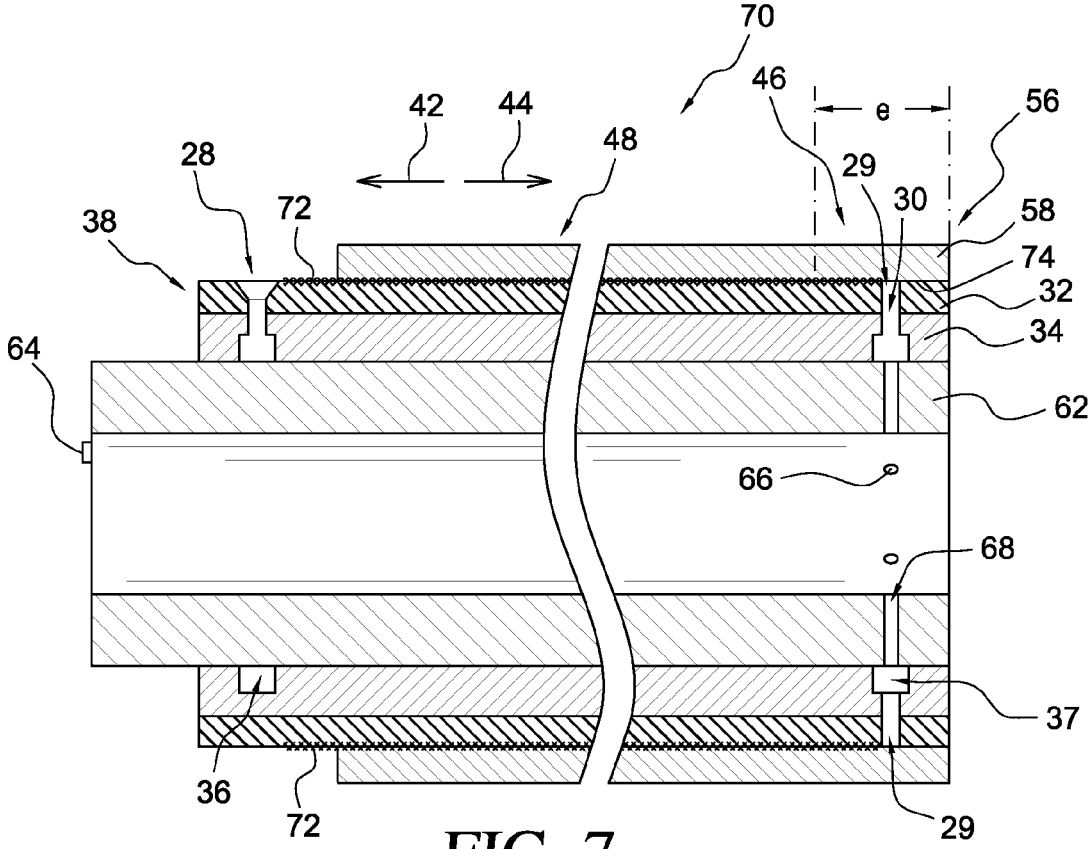

FIG. 7 is a partial cross-sectional view of a print sleeve and mandrel according to still another exemplary embodiment of the present disclosure.

DETAILED DESCRIPTION OF THE INVENTION

Figure 1:
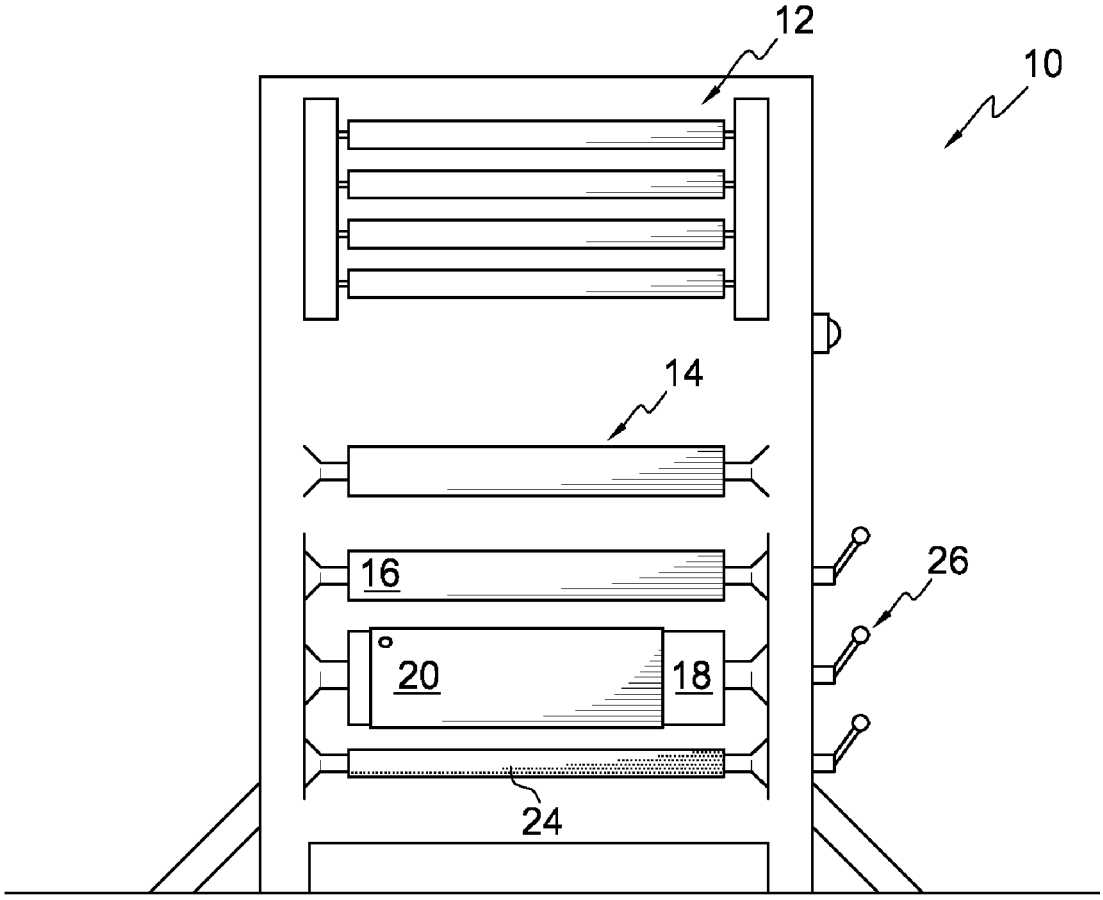
FIG. 1 is an elevational view of a print press according to an exemplary embodiment of the present disclosure.

FIG. 1 illustrates a print press 10 according to an exemplary embodiment of the present disclosure. As shown in FIG. 1, the print press 10 may include, for example, a tension assembly 12, a plurality of rollers 14, 16, a mandrel 18, and an ink roller 24. In operation, a print sleeve 20 may be fixedly mounted to the mandrel 18. The print press 10 may also include any number of knobs, levers, adjustment arms, and/or other controllers 26 configured to adjust, for example, the relative position and engagement of the rollers 14, 16, the mandrel 18, and/or the ink roller 24. Although not shown in FIG. 1, the print press 10 may also include a set of nips upstream of the ink roller 24 configured to draw a web of material such as, for example, paper, plastic, and/or other packaging materials into the print press 10 at a desired rate. Such a web of material may be drawn into the print press 10 via the nips and may then be directed between the roller 16 and the print sleeve 20. The print press 10 may also include (not shown) an ink supply proximate the ink roller 24. The ink supply may include components commonly known in the art configured to apply a layer of ink, dye, and/or other printing chemical to the surface of the ink roller 24. In an exemplary embodiment, the ink may be supplied to the ink roller 24 at a desired pressure and the ink supply may include one or more blades, brushes, and/or other metering components configured to consistently apply the ink to the ink roller 24 to form a layer of ink having a desired thickness on the ink roller 24.

The ink roller 24 may be disposed substantially parallel to the mandrel 18 and/or the print sleeve 20, and the ink roller 24 may be moved to contact an outer surface of the print sleeve 20 having a raised printing portion. The ink roller 24 may thus apply ink to the raised printing portion such that a corresponding image of the printing portion may be formed on the web of material as it comes into contact with the raised portion of the print sleeve 20. The roller 16 may be disposed substantially parallel to the mandrel 18 and/or the print sleeve 20, and may be movable in order to contact the raised surface of the print sleeve 20, thereby assisting in the formation of the image of the web of material. As will be described in greater detail below, the raised surface of the print sleeve 20 may be formed by, for example, removing portions of the outer surface of the print sleeve 20. Alternatively, the outer surface of the print sleeve 20 may be substantially uniform and smooth. In such an exemplary embodiment, a print plate may be adhered and/or otherwise fixed to the outer surface of the print sleeve 20 to form an image on the web of material as it passes between the print sleeve 20 and the roller 16.

Upon passing between the roller 16 and the print sleeve 20, the web of material may be directed to, for example, the roller 14. The roller 14 may guide the web of material into the tension assembly 12. As shown in FIG. 1, the tension assembly 12 may include, for example, a plurality of rollers. The rollers and/or other components of the tension assembly may be, for example, spring loaded and/or otherwise configured to regulate the speed and/or tension of the web of material as it passes through the print press 10 to other downstream material handling assemblies.

As shown in FIG. 2, an exemplary mandrel 18 of the present disclosure may be, for example, substantially cylindrical and may define a centerline along a longitudinal axis thereof. The mandrel 18 may be comprised of any metal, composite, alloy, and/or other material known in the art such as, for example, stainless steel, aluminum, and/or alloys thereof. The mandrel 18 may have a substantially uniform outer surface 41 and, in an exemplary embodiment, the outer surface 41 may be substantially smooth in order to facilitate mounting of, for example, the print sleeve 20 on the mandrel 18. The mandrel 18 may have any diameter known in the art in order to facilitate the use of desired print sleeves 20. In an exemplary embodiment, the mandrel 18 may be substantially hollow and may include, for example, end plates, and/or other components configured to assist the print press 10 (FIG. 1) in rotating the mandrel 18 during use. In addition, although the mandrel 18 shown in FIG. 2 does not include orifices and/or other passages whereby a pressurized flow of air could be delivered to a print sleeve mounted thereon, it is understood that exemplary embodiments of the mandrel 18 (such as the embodiment shown in FIG. 7) may include such passages. Accordingly, the print sleeves of the present disclosure may be configured for use on either mandrel type.

FIG. 2 also illustrates an exemplary print sleeve 20 of the present disclosure. As shown in FIG. 2, the print sleeve 20 may be substantially cylindrical and, in an exemplary embodiment, the print sleeve 20 may be sized, shaped, and/or otherwise configured to fixedly mate with the nonporous outer surface 41 of the mandrel 18. In particular, at least a portion of the print sleeve 20 may be circumferentially expandable. In such an exemplary embodiment, the circumferentially expandable portion of the print sleeve 20 may expand in response to a flow of pressurized air being directed between, for example, an inner surface 40 (FIG. 3) of the print sleeve 20 and the outer surface 41 of the mandrel 18. In such an exemplary embodiment, the print sleeve 20 may be configured to fixedly mate with the nonporous outer surface 41 in response to removal of the pressurized flow of air. Such a pressurized flow may be, for example, shop air, or air from any other compressed air source known in the art.

The print sleeve 20 may be made from any metal, alloy, composite, and/or other material known in the art. In addition, the print sleeve 20 may be coated with one or more layers of additional material configured to assist in the printing process. In an exemplary embodiment, the print sleeve 20 may comprise a composite layer forming the inner surface 40 and a rubber layer forming an outer surface 39 thereof. In an additional exemplary embodiment, the print sleeve 20 may comprise a nickel layer forming at least a portion of the inner surface 40 and a rubber layer forming the outer surface 39. Although FIGS. 2, 3, and 4 illustrate an exemplary embodiment of the print sleeve 20 comprising a composite layer forming the inner surface 40 and a rubber layer 32 forming the outer surface 39, and FIGS. 5 and 6 illustrate a print sleeve 50, 60 comprising a nickel layer 52 forming the inner surface and a rubber layer 32 forming the outer surface 39, it is understood that in additional exemplary embodiments of the present disclosure the rubber layer 32 of the print sleeve may be omitted. In such exemplary embodiments, the raised portions 22 may be formed directly on either the composite layer 34 or the nickel layer 52. Alternatively, one or more print plates (not shown) may be adhered to and/or otherwise fixed to the composite layer 34 or the nickel layer 52 for printing applications.

As shown in FIG. 2, the raised portion 22 of the outer surface 39 may comprise any design, image, text, and/or other configuration known in the art. The raised portion 22 may be configured to form a corresponding image on, for example, a web of packaging material coming into contact therewith. The raised portion 22 may be formed by any known process such as, for example, laser etching, chemical etching, and molding. For example, in an embodiment of the present disclosure wherein the print sleeve 20 includes a rubber layer 32 forming the outer surface 39, the raised portion 22 may be formed by burning away and/or otherwise removing portions of the outer surface 39 in a laser etching process. In such a process, the print sleeve 20 is rotated at relatively high speeds and is acted upon by a high intensity laser to burn away portions of the rubber layer 32, leaving a desirable image formed at the raised portion 22.

The outer surface 39 of the print sleeve 20 may also define at least one port 28. As illustrated in, for example, FIGS. 3 and 4, the port 28 may comprise a thru hole formed in the outer surface 39. In an exemplary embodiment, the port 28 may include a taper and/or any other shape or configuration. Such a taper may facilitate, for example, the insertion of an air nozzle and/or other component configured to direct a flow of pressurized air into the port 28. As illustrated by the dotted lines in FIG. 2, in an exemplary embodiment in which the outer surface 39 includes a raised portion 22 for printing, a portion of the rubber layer 32 proximate the port 28 may be removed to avoid incidental printing. As shown in FIG. 2*a*, removing a portion of the rubber layer 32 may expose an intermediate surface 43 of the rubber layer 32 having a diameter less than a diameter of the outer surface 39.

As shown in FIG. 3, the port 28 may be fluidly connected to a channel 36 defined and/or otherwise at least partially formed by the inner surface 40 of the sleeve 20. In an exemplary embodiment, the port 28 may be fluidly connected to the channel 36 via one or more passages 30 formed in the print sleeve 20. As shown in FIG. 3, in an embodiment in which the print sleeve 20 comprises a composite layer 34 forming the inner surface 40 and a rubber layer 32 forming the outer surface 39, the port 28 may be at least partially formed by the rubber layer 32. Alternatively, in an exemplary embodiment in which the print sleeve 50, 60 comprises a nickel layer 52 forming the inner surface 54 (FIGS. 5 and 6) and a rubber layer 32 forming the outer surface 39, the port 28 may be formed substantially completely by the rubber layer 32. Alternatively, in embodiments in which the rubber layer 32 has been omitted, the port 28 may be formed by either the composite layer 34 or the nickel layer 52. It is also understood that the port 28 may be formed at substantially any angle to facilitate directing a flow of pressurized air into the channel 36 from the outer surface 39 of the print sleeve 20. In an exemplary embodiment, the port 28 and/or the passage 30 may be formed in a plane that is normal to, for example, a centerline of the print sleeve 20 and/or a longitudinal axis of the print sleeve 20. In such an exemplary embodiment, the port 28 may be formed in a side wall of the rubber layer 32 and the passage 30 may extend through the rubber layer 32 in a direction parallel to the longitudinal axis of the print sleeve 20. Such a passage 30 may then extend normal to the longitudinal axis of the print sleeve 20 so as to fluidly connect with the channel 36. Alternatively, as illustrated in, for example, FIGS. 2 and 3, the port 28 may be formed in a plane substantially parallel to the longitudinal axis and/or centerline of the print sleeve 20. In such an exemplary embodiment, the port 28 may be formed by the outer surface 39 of the print sleeve 20.

The channel 36 may have any shape, size, and/or other configuration known in the art. For example, as shown in at least FIG. 3, the channel 36 may be substantially annular. The channel 36 may be formed in the inner surface 40 of the print sleeve 20 through any mechanical means such as, for example, reaming, milling, and/or other processes. Alternatively, in embodiments of the print sleeve 20 wherein the composite layer 34 forms the inner surface 40, the channel 36 may be formed into the composite layer 34 during the molding and/or curing process used to fabricate the composite layer 34. The channel 36 may be configured to form a substantially uniform ring, pocket, and/or other known collection of pressurized air between the inner surface 40 of the print sleeve 20 and the nonporous outer surface 41 of the mandrel 18 when the print sleeve 20 is disposed on the mandrel 18. Accordingly, it is understood that at least a portion of the outer surface 41 of the mandrel 18 may form a portion of the channel 36. The port 28 may have any diameter known in the art and, in an exemplary embodiment, the port 28 and/or the passage 30 may have a diameter of approximately 0.080 inches.

As shown in FIG. 4, the port 28 may be disposed at any desirable distance d from a leading edge 38 of the print sleeve 20. In an exemplary embodiment, a centerline of the port 28 and/or the passage 30 may be disposed at a distance d equal to approximately 0.50 inches from the leading edge 38 of the sleeve 20. In such an exemplary embodiment, a centerline of the annular channel 36 may also be disposed at a distance d equal to approximately 0.50 inches from the leading edge 38 of the print sleeve 20. As discussed above, the channel 36 may have any shape, size, and/or other configuration configured to distribute a pressurized flow of air substantially uniformly about the outer surface 41 of the mandrel 18 and/or about the inner surface 40 of the print sleeve 20. In an exemplary embodiment, the channel 36 may be, approximately, 0.250 inches wide and, in such an exemplary embodiment, the channel 36 may be between approximately 0.015 and approximately 0.020 inches deep. In addition, it is understood that the layers of the print sleeve 20 may have any desirable thickness known in the art and, in an exemplary embodiment, the composite layer 34 of the print sleeve 20 may be between approximately 0.040 and approximately 0.060 inches thick. In such an exemplary embodiment, a channel 36 having a depth of 0.020 inches may be formed substantially completely by the composite layer 34 and the outer surface 41 of the mandrel 18. Such an exemplary embodiment is illustrated in, for example, FIGS. 3 and 4.

In exemplary embodiments of the present disclosure in which the print sleeve 50, 60 comprises a nickel layer 52 forming at least a portion of the inner surface 54 and a rubber layer 32 forming at least a portion of the outer surface 39, on the other hand, it is understood that the nickel layer 52 may have a smaller thickness than the composite layer 34. For example, the nickel layer 52 may have a thickness of, approximately, 0.005 inches and, as shown in FIG. 6, in such an exemplary embodiment the nickel layer 52 may form only a portion of the channel 36. In such an exemplary embodiment, the remainder of the channel 36 may be formed by the rubber layer 32 and by the outer surface 41 of the mandrel 18. As shown in FIG. 6, in such an exemplary embodiment, the nickel layer 52 may be disposed on either side of the channel 36. Alternatively, in an additional exemplary embodiment, the nickel layer 52 may only form a portion of the channel 36 on a single side thereof. In such an exemplary embodiment, the remainder of the channel 36 may be formed substantially by the rubber layer 32 and the outer surface 41. As shown in FIG. 5, in still another exemplary embodiment of the present disclosure, the channel 36 may be substantially entirely formed by the rubber layer 32 and the outer surface 41. In such an exemplary embodiment, the nickel layer 52 may terminate at a desired distance e from the leading edge 38 of the print sleeve 50. The distance e may vary based on, for example, customer requirements for different printing applications. It is also understood that although the outer surface 41 of the mandrel 18 is described herein as forming at least a portion of the channel 36, in each embodiment, the mandrel 18 may be a substantially uniform cylinder and no portions of the mandrel 18 may be removed to form a portion of the channel 36. Thus, only components of the print sleeves 20, 50, 60, 70 of the present disclosure may be removed to form the channel 36, and the mandrel 18 may only form a portion of the channel 36 when the print sleeves of the present disclosure are disposed thereon and/or otherwise mated with the mandrel 18.

The rubber layer 32 may comprise any natural and/or synthetic rubber material known in the art. The type of material used to form the rubber layer 32 may depend upon a variety of factors including but not limited to the composition of the ink used in the printing process. Other factors determining the type of material used in the rubber layer 32 may also include the solvents utilized to clean the outer surface 39, the dyne level of the inks utilized in the printing process, and the other chemicals coming into contact with the outer surface 39 during the printing and/or cleaning process.

In an exemplary embodiment, a first portion 46 of the rubber layer 32 may have a different durometer than a second portion 48 of the rubber layer 32. In such an exemplary embodiment, the first portion 46 may be proximate the leading edge 38 of the rubber layer 32 and may at least partially form the port 28 and/or the passage 30. In such exemplary embodiments, the first portion 46 may have a durometer between approximately 90 Shore A and approximately 70 Shore D to assist in substantially prohibiting pressurized air directed into the port 28 from exiting proximate the leading edge 38 of the print sleeve 50, 60. In particular, the relatively hard durometer rubber making up the first portion 46 may assist in retaining the flow of pressurized air within the channel 36. The hard durometer rubber of the first portion 46 may substantially prohibit the pressurized air disposed within the channel 36 from escaping at the leading edge 38 of the print sleeve 50, 60 during, for example, movement of the print sleeve 50, 60 along the mandrel 18. Instead, the pressurized air from the channel 36 may be forced to propagate substantially along the outer surface 41 of the mandrel 18 forming a pocket of air between the print sleeve and the mandrel 18.

The second portion 48, on the other hand, may have a relatively soft durometer between approximately 36 Shore A and approximately 90 Shore A. In such an exemplary embodiment, the second portion 48 may form the raised portion 22 (FIG. 2) utilized as a printing surface of the print sleeve 50, 60. Although not shown in FIGS. 5 and 6, it is understood that to form a rubber layer 32 having portions 46, 48 characterized by different durometers, the first layer 46 may be initially disposed on, for example, the nickel layer 52. A section of the first portion 46 may then be removed through known etching, engraving, and/or other processes, and the second layer 48 of a different durometer may then be disposed, molded, and/or otherwise formed on the first portion 46 of the rubber layer 32 to replace the section removed therefrom.

As shown in FIGS. 5 and 6, the rubber layer 32 may have a single uniform outer diameter. Moreover, in an additional exemplary embodiment, the rubber layer 32 may comprise two or more layers of rubber material that extend the entire length of the print sleeve. In such an exemplary embodiment, the rubber layer contacting the composite layer 34 or the nickel layer 52 may have a first durometer between approximately 20 Shore A and approximately 60 Shore A, and this first rubber layer may act as a cushion or a base layer having any desirable thickness. In such an exemplary embodiment, a second rubber layer may be disposed on the first rubber layer, and the second rubber layer may have a durometer between approximately 50 Shore D and approximately 70 Shore D. In such an exemplary embodiment, the outer rubber layer may be configured for cross-hatching, laser engraving, and/or other material removal processes. Thus, the rubber layers of the print sleeves described herein may have a variety of configurations, thicknesses, and/or other arrangements depending upon the printing application in which they are being used. Such varying configurations may provide desirable mechanical properties at the outer surface 39 of the print sleeve for a wide range of printing applications. In an exemplary embodiment, the grooves of the cross-hatched outer surface 72 may be disposed at 45° angles relative to each other, and the centerlines of each respective groove may be disposed proximately 0.125 inches apart. It is understood that the grooves may have any depth, width, and/or other configuration to facilitate the flow of air from a port 29 fluidly connected to the channel 37 to the outer surface 72 of the print sleeve 70.

For example, as shown in FIG. 7, an exemplary embodiment of the print sleeve 70 may include a rubber layer 32 wherein a portion of the rubber layer 32 has a different durometer, and thus different surface characteristics, than a remainder of the rubber layer 32. For example, a portion 72 of the outer surface of the print sleeve 70 having a lower durometer may be cross-hatched while an additional portion 74 of the outer surface disposed proximate a trailing edge 56 of the print sleeve 70 may be substantially smooth. In the embodiment illustrated in FIG. 7, the print sleeve 70 may have a channel 36 and a port 28 disposed proximate the leading edge 38 of the print sleeve 70 that are substantially the same as the channel 36 and port 28 described above with respect to FIGS. 2-4. In particular, the channel 36 may be formed substantially by the composite layer 34, and the annular channel 36 may be fluidly connected to the port 28 formed substantially by the rubber layer 32. Directing a flow of pressurized air to the channel 36 through the port 28 may facilitate mounting the print sleeve 70 on the mandrel 62, and positioning the print sleeve 70 at a desired location on the mandrel 62.

The mandrel 62 illustrated in FIG. 7, on the other hand, may differ from the mandrels 18 discussed above in that the mandrel 62 may include an inlet 64 configured to receive a flow of pressurized air. The mandrel 62 may also include a plurality of thru holes 66 extending from an inner diameter of the mandrel 62 to the outer surface of the mandrel 62. Thus, the mandrel 62 may be configured to receive a flow of pressurized air through the inlet 64 and to direct the pressurized flow of air from within the mandrel 62 to the outer surface of the mandrel 62 via the thru holes 66. Passages 68 fluidly connecting the inner diameter of the mandrel 62 to the outer surface thereof may direct this pressurized flow to the outer surface of the mandrel 62.

Accordingly, to receive a pressurized flow of air from the plurality of thru holes 66, the print sleeve 70 may include an additional channel 37 disposed proximate the trailing edge 56. The channel 37 may be substantially similar to the channel 36 disposed proximate the leading edge 38, and may be fluidly connected to the cross-hatched outer surface 72 and/or the relatively smooth outer surface 74 of the print sleeve 70 via a plurality of passages 30 and ports 29. In particular, the channel 37 may be configured to direct a flow of pressurized air from within the mandrel 62 to at least the cross-hatched outer surface 72 of the print sleeve 70 via the passages 30 and ports 29.

As discussed above, a first portion of the rubber layer 32 may have a different durometer than, for example, a second portion of the rubber layer 32. In the exemplary embodiment of FIG. 7, the cross-hatched outer surface 72 may have a durometer between approximately, 35 Shore A and approximately 90 Shore A, while the substantially smooth outer surface 74 proximate the trailing edge 56 may have a durometer between approximately 90 Shore A and approximately 70 Shore D. The cross-hatching may extend between, for example, the port 28 and the plurality of ports 29. In additional exemplary embodiments, the outer surface may include alternate patterns that are not cross-hatched such as, but not limited to, spiral patterns, circular dots, stripes, and diamond shaped patterns. Such patterns, in conjunction with the softer durometer rubber material used between the channels 36, 37 may, for example, facilitate disposing an additional sleeve 58 on the outer surface 72 of the print sleeve 70. The additional sleeve 58 may be, for example, a thin sleeve utilized in known printing applications. In an exemplary embodiment, directing a flow of pressurized air from within the mandrel 62 to the cross-hatched outer surface 72 of the print sleeve 70 via the channel 37 and the ports 29 may assist in forming an air pocket between the cross-hatched outer surface 72 and an inner surface of the additional sleeve 58. Such an air pocket may facilitate movement of the additional sleeve 58 along the cross-hatched outer surface 72 and may enable the additional sleeve 58 to be desirably positioned on the print sleeve 70. In addition, the relatively hard durometer rubber material disposed proximate the trailing edge 56 may assist in substantially prohibiting the pressurized flow of air from escaping at the trailing edge 56. It is understood that the additional sleeve 58 may be fixedly mated with the print sleeve 70 once the pressurized flow of air is removed from, for example, the channel 37.

The first portion 46 comprising relatively hard durometer rubber may extend a distance e from the trailing edge 56 of the print sleeve 70, and as shown in FIG. 7, the first portion 46 may extend beyond the channel 37. In such an exemplary embodiment, the cross-hatching disposed on the outer surface 72 may still begin at the passage 30 fluidly connected to the channel 37 to facilitate the flow of pressurized air from the channel 37 to the outer surface. Thus, the hard durometer rubber of the portion 46 may be relatively smooth between the trailing edge 56 and a port 29 fluidly connected to the passage 30, and the remainder of the hard durometer rubber may be cross-hatched on the opposite side of the port 29 from the smooth outer surface 74. As discussed above with respect to the channel 36, a centerline of the channel 37, the port 29, and the passage 30 fluidly connecting the channel 37 to the port 29 may be disposed approximately 0.50 inches from the trailing edge 56, and this dimension may vary depending on the requirements of the printing application for which the print sleeve 70 is used. Likewise, the distance e that the relatively hard durometer rubber extends from the trailing edge 56 may vary based on the configuration of the additional sleeve 58 disposed on the print sleeve 70, the configuration of the mandrel 62 and/or the particular requirements of the printing application for which the print sleeve 70 is being used. In addition, it is understood that the harder durometer rubber of the portion 46 may have a durometer between approximately 90 Shore A and approximately 70 Shore D, while the relatively soft durometer rubber of portion 48 may have a durometer between approximately 35 Shore A and approximately 90 Shore A.

In an exemplary embodiment, the grooves of the cross-hatching may be, approximately, 0.003 inches deep and, approximately 0.003 inches wide. It is understood that if the grooves of the cross-hatching are too deep and wide, the flow of pressurized air directed to the cross-hatched outer surface 72 may escape relatively easily therefrom thus limiting the movability of the additional sleeve 58 along the outer surface 72. Alternatively, if the cross-hatched grooves are too shallow, the flow of pressurized air may not be capable of forming an air pocket between the cross-hatched outer surface 72 and an inner surface of the additional sleeve 58, thereby making it difficult to move the additional sleeve 58 along the outer surface 72.

The print sleeves of the present disclosure may be used in a wide variety of printing applications and other applications in which carrier rolls or mandrels are used. In addition, the print sleeves described herein may be useful in print presses or other printing assemblies utilizing mandrels that are not air fed. In particular, because the print sleeves of the present disclosure are configured to accept a flow of pressurized air via a port on the outer surface thereof, the print sleeves may be easily movable along the outer surface of non-air fed mandrels and the print sleeves may have a length substantially shorter than a length of the non-air fed mandrels since movement and/or positioning the print sleeves of the present disclosure can be done without receiving a flow of pressurized air from, for example, a leading edge of the mandrel. Reducing the length of the print sleeves may be particularly desirable in applications in which the printed image and/or the web of material on which the images to be printed is substantially narrower than the length of the mandrel used in standard print presses. In particular, the use of shorter print sleeves may result in a significant cost savings over traditional print sleeves having a length substantially equal to the length of the mandrel.

Unless otherwise noted, the print sleeve 20 and mandrel 18 illustrated in FIGS. 2-4 will be referred to for the duration of this disclosure for ease of discussion. In an exemplary method of configuring a printing assembly such as, for example, the print press 10 described above, the print sleeve 20 may be at least partially disposed on the mandrel 18. For example, the inner surface 40 of the print sleeve 20 may be disposed about the outer surface 41 of the mandrel 18, and the leading edge 38 may be forced onto the mandrel 18 until, for example, the port 28 and/or the channel 36 is disposed in fluid communication with the outer surface 41 of the mandrel 18. A flow of pressurized air such as, for example, shop air may then be directed into the port 28 using a nozzle or other like device. The flow of pressurized air may pass from the port 28 to the channel 36 via the passage 30, and the channel 36 may become filled with the flow of pressurized air. Due to the relatively hard durometer rubber at the leading edge 38, pressurized air escaping the channel 36 may flow in the direction of arrow 44 to form a pocket of air between the inner surface 40 of the sleeve 20 and the outer surface 41 of the mandrel 18. It is understood that the pocket of air may be substantially uniform about the circumference of the outer surface 41 and, in an exemplary embodiment, the pocket of air may be substantially cylindrical. In an exemplary embodiment, the air pocket may extend from the channel 36 to, for example, the trailing edge of the print sleeve 20. The pressurized channel 36 and the pocket of air discussed above may facilitate movement of the print sleeve 20 along the outer surface 41 in the direction of arrow 42. Although FIG. 2 illustrates a mandrel 18 that does not include, for example, thru holes 66 and/or other orifices defined by the mandrel to facilitate the flow of pressurized air therefrom, it is understood that in an exemplary embodiment such as the embodiment illustrated in FIG. 7, in which the mandrel 62 includes such thru holes 66, the print sleeve 70 may be desirably positioned along the mandrel 62 such that the inner surface 40 is fluidly disconnected from any of the thru holes 66 and/or other orifices defined by the mandrel 62.

With continued reference to FIG. 2, once the print sleeve 20 has been moved laterally along the mandrel 18 in the direction of arrow 42 or arrow 44 to a desired position along the mandrel 18, the print sleeve 20 may be fixedly mated with the mandrel 18 by removing the flow of pressurized air. In particular, it is understood that while the flow of pressurized air is being directed to the channel 36, at least a portion of the print sleeve 20 may be circumferentially expanded to, for example, facilitate the formation of the air pocket between the inner surface 40 and the outer surface 41. Thus, removing the flow of pressurized air may cause the circumferentially expanded portion of the print sleeve 20 to contract, thereby causing the print sleeve 20 to lock down on and/or otherwise fixedly mate with the outer surface 41. It is also understood that in order to remove the print sleeve 20 from the mandrel 18 after the print sleeve 20 has been fixedly mated thereto, the user may again direct a flow of pressurized air from the port 28 to the channel 36, thereby forming a cylindrical air pocket between the outer surface 41 of the mandrel 18 and the inner surface 40 of the print sleeve 20. The flow of pressurized air disposed within the channel 36 and/or the cylindrical air pocket that has been formed, may assist the user in moving the print sleeve 20 laterally along the mandrel 18 in the direction of arrow 44 to remove the print sleeve 20 therefrom.

It is understood that in embodiments of the print sleeve 20 wherein the inner surface 40 is formed by a composite layer 34, a portion of the composite layer 34 may be circumferentially expandable to a varying degree in order to facilitate the formation of the substantially cylindrical air pocket discussed above. Likewise, in the exemplary embodiment illustrated in FIG. 5 in which the inner surface 54 of the print sleeve 50 is formed by a rubber layer 32 at the leading edge 38 and by a nickel layer 52 beginning a distance e from the leading edge 38, the rubber layer 32 may assist in lifting the nickel layer 52 at the leading edge 38 and a portion of the nickel layer 52 may facilitate the formation of a substantially cylindrical air pocket along at least a portion of the outer surface 41 of the mandrel 18.

Moreover, in the exemplary embodiment illustrated in FIG. 6 wherein substantially the entire inner surface 54 of the print sleeve 60 is formed by a nickel layer 52, the portion of the nickel layer 52 disposed proximate the leading edge 38 and/or the portion of the rubber layer 32 disposed on the nickel layer 52 proximate the leading edge 38 may assist in lifting the nickel layer 52 at the leading edge 38. It is understood that the rubber material in the portion 46 of the rubber layer 32 extending a distance e from the leading edge 38 (FIGS. 5 and 6) may be of a harder durometer than the rubber material making up, for example, a remaining portion 48 of the rubber layer 32.

In addition, in the exemplary embodiment illustrated in FIG. 7 in which the mandrel 62 is configured to receive a flow of pressurized air via an inlet 64 and direct the flow of pressurized air from within the mandrel 62 to an outer surface of the mandrel 62 via a plurality of thru holes 66, the print sleeve 70 of the present disclosure may be configured to receive the flow of pressurized air from the mandrel 62 in order to facilitate positioning an additional sleeve 58 on the outer surface 72 of the sleeve 70. In such an exemplary embodiment, the print sleeve 70 may be engaged with the mandrel 62 in substantially the same way described above with respect to FIGS. 2-4. In addition, the print sleeve 70 may be positioned on the mandrel 62 such that the channel 37 is substantially aligned with the plurality of thru holes 66. Once so positioned, the flow of pressurized air being directed from the port 28 to the channel 36 may be removed, thereby fixedly mating the print sleeve 70 with the mandrel 62. A flow of pressurized air may then be directed into the inlet 64. The thru holes 66 and passages 68 may direct this flow of pressurized air from within the mandrel 62 to the channel 37. It is understood that due to the positioning of the print sleeve 70, the channel 37 may be in fluid communication with the plurality of thru holes 66. The additional sleeve 58 illustrated in FIG. 7 may then be disposed about an outer circumference of the print sleeve 70. In particular, the additional sleeve 58 may be disposed about the outer circumference of the print sleeve 70 and mandrel 62, and the flow of pressurized air being directed to the channel 37 from the thru holes 66 may form a substantially cylindrical air pocket between the cross-hatched outer surface 72 of the print sleeve 70 and an inner surface of the additional sleeve 58. The cross-hatching disposed on the outer surface 72 may assist in propagating the flow of pressurized air from the plurality of ports 29 along a length of the print sleeve 70 as the additional sleeve 58 is moved laterally in the direction of arrow 42 along the surface of the print sleeve 70. In addition, the relatively smooth outer surface 74 of the print sleeve 70 may assist restricting the pressurized flow of air from escaping at the trailing edge 56 of the print sleeve 70 to further assist in forming the substantially cylindrical air pocket discussed above. Once the additional sleeve 58 has been desirably positioned on the print sleeve 70, the flow of pressurized air may be removed from the inlet 64, thereby fixedly mating the additional sleeve 58 with the print sleeve 70. Similar to the print sleeves described herein, the additional sleeve 58 may be at least partially circumferentially expandable to facilitate the formation of the substantially cylindrical air pocket, and removal of the flow of pressurized air from, for example, the ports 29 may cause the additional sleeve 58 to contract, thereby locking and/or otherwise fixedly mating the additional sleeve 58 to the print sleeve 70. With the additional sleeve 58 fixedly mounted in place, a flow of pressurized air may again be directed to the channel 36 via the port 28 of the print sleeve 70. The flow of pressurized air directed to the channel 36 may again form a substantially cylindrical pocket of air between the outer surface of the mandrel 62 and the inner surface 40 of the print sleeve 70. The print sleeve 70 and the additional sleeve 58 may then be moved in unison along the outer surface of the mandrel in the direction of either arrow 42 or 44 until the additional sleeve 58 is desirable located relative to, for example, a web of material being fed through the print press 10 (FIG. 1). As discussed above, the flow of pressurized air fed to the channel 36 and/or the substantially cylindrical pocket of air formed between the outer surface of the mandrel 62 and the inner surface 40 of the print sleeve 70 may facilitate movement of the print sleeve 70 and the additional sleeve 58 in unison along the outer surface of the mandrel 62. Moreover, the print sleeve 70 may once again be locked in place and/or otherwise fixedly mated to the mandrel 62 by removing the flow of pressurized air from, for example, the port 28.

Additional embodiments of the present disclosure may be apparent to those skilled in the art. Thus, the present disclosure should not be limited to the embodiments disclosed herein.

The invention claimed is:

1. A printing sleeve assembly for cooperatively engaging a mandrel and forming a predetermined image on a web, the printing sleeve assembly, comprising:

(a) a cylindrical print sleeve having an inner surface and an outer surface, the inner surface defining a first channel and the outer surface defining a port fluidly connected to the first channel;

(b) the inner surface (i) circumferentially expandable in response to a first flow of pressurized air being directed into the first channel from the port, the circumferential expansion sufficient to enable lateral displacement of the print sleeve along the mandrel, and (ii) circumferentially contractible to fixedly mate the print sleeve with the mandrel in an operable position in response to removal of the first flow;

(c) the outer surface having an ink carrying raised portion corresponding to the predetermined image and an adjacent recessed portion; and (d) the print sleeve sized to expose the port independent of the position of the print sleeve relative to the mandrel.

2. The assembly of claim 1, wherein the print sleeve comprises a composite layer forming the inner surface and a rubber layer forming the outer surface.

3. The assembly of claim 2, wherein the port is at least partially formed by the rubber layer.

4. The assembly of claim 2, wherein the port is formed in a plane normal to a longitudinal axis of the print sleeve.

5. The assembly of claim 2, wherein a first portion of the rubber layer is characterized by a different durometer than a second portion of the rubber layer.

6. The assembly of claim 1, wherein the first channel is annular.

7. The assembly of claim 1, wherein the sleeve comprises a nickel layer forming at least a portion of the inner surface and a rubber layer forming the outer surface.

8. The assembly of claim 7, wherein a first portion of the rubber layer forming the port is characterized by a higher durometer than a durometer of a second portion of the rubber layer.

9. The assembly of claim 7, wherein at least a portion of the first channel is formed by the rubber layer.

10. The assembly of claim 7, wherein the nickel layer is disposed on at least one side of the first channel.

11. The assembly of claim 1, wherein a portion of the outer surface defining the port has a smaller diameter than a diameter of a remainder of the outer surface.

12. The assembly of claim 1, wherein the outer surface is defined by a print plate.

13. A printing assembly for applying an ink to a web, comprising:

(a) a first cylinder rotatable about a first axis;

(b) a mandrel for rotation about a second axis; and (c) a cylindrical print sleeve having an inner surface and an outer surface, the outer surface forming a nip with the first cylinder, the inner surface defining a first channel and the outer surface defining a port fluidly connected to the first channel, the print sleeve sized to receive a length of the mandrel in an operable position of the print sleeve; and (d) the inner surface (i) circumferentially expandable in response to a first flow of pressurized air being directed into the first channel from the port and (ii) circumferentially contractible to fixedly mate the print sleeve with the mandrel in response to removal of the first flow; and the port exposed in the operable position of the print sleeve.

14. An improved print press having a nip between a pair of opposing rotating assemblies, a first of the rotating assemblies including a mandrel, and a web passing through the nip, an image formed on the web by passing through the nip, the improvement comprising:

(a) a print sleeve engaged with the mandrel for rotation with the mandrel, the print sleeve having an inner surface and an outer surface, the inner surface defining a first channel and the outer surface defining a port fluidly connected to the first channel;

(b) the inner surface (i) circumferentially expandable in response to a first flow of pressurized air being directed into the first channel from the port, the circumferential expansion sufficient to enable lateral displacement of the print sleeve along the mandrel, and (ii) circumferentially contractible to engage the print sleeve with the mandrel in an operable position in response to removal of the first flow; and (c) the outer surface of the print sleeve having an ink carrying raised portion defining the image and an adjacent relatively recessed portion, the raised portion defining a portion of the nip.

15. The improved print press of claim 14, wherein the outer surface is defined by a print plate.

16. The improved print press of claim 14, wherein the outer surface is a rubber.

* * * * *